US005497632A

United States Patent [19]

Robinson

[11] Patent Number: 5,497,632

[45] Date of Patent: Mar. 12, 1996

[54] HEATING SYSTEM HAVING INCREASED AIR CIRCULATION

[76] Inventor: Kevin R. M. Robinson, 1094 Westminster Blvd., Windsor, Ontario, Canada, N8S 2C4

[21] Appl. No.: 250,536

[22] Filed: May 31, 1994

[30] Foreign Application Priority Data

May 25, 1994 [CA] Canada ..... 2124281

[51] Int. Cl.[6] ..... F24F 7/00

[52] U.S. Cl. ..... 62/180; 62/262; 454/233; 236/49.3

[58] Field of Search ..... 62/180, 262 F; 454/233, 229, 236; 236/49.3

[56] References Cited

U.S. PATENT DOCUMENTS 3,410,105 11/1968 Marsteller ..... 62/262 X 4,779,671 10/1988 Dolison ..... 454/236 X 5,097,674 3/1992 Imaiida et al. ..... 454/236 X

*Primary Examiner*—William E. Wayner

*Attorney, Agent, or Firm*—Riches, McKenzie & Herbert

[57] ABSTRACT

A heating system for heating or cooling a volume of air, such as the air within a room, is disclosed. The heating system includes a heating means which when activated can heat or cool the volume of air and an air circulation means which when activated can circulate the air within the room. The system also comprises a sensor which senses the activation of the heating means and substantially simultaneously sends a control signal to activate the air circulation means. The air circulation means comprises a fan to circulate the air in the room in response to the control signal. The air circulation means also comprises a low voltage relay which responds to short timed pulses.

16 Claims, 2 Drawing Sheets

HEATING SYSTEM HAVING INCREASED AIR CIRCULATION

BACKGROUND OF THE INVENTION

This invention relates to a system and process for improving heating and cooling of rooms in buildings Different types of heating and cooling systems have been used in the past, such as forced air, electrical, water radiator, convection, etc. Generally, these heating and cooling systems are controlled by a thermostat and operate intermittently in response to signals from the thermostat.

The difficulty with all existing heating and cooling systems is that the systems provide heating or cooling to a specific part of a room and then rely on the natural air currents within the actual room to transfer the heat or cooling throughout the room. This is often unsatisfactory because hot and cool air within a room tend to stratify with the hotter air at the top of the room, near the ceiling, and the cooler air at the bottom of the room, near the floor. In other words, a temperature gradient is formed within the room from the floor to the ceiling. This often causes the room to be uncomfortable.

Furthermore, depending on the height of the thermostat on the wall of a room, this temperature gradient may cause the cooling system to operate unnecessarily because the thermostat will sense the temperature of warmer air at the upper half of the room, thereby operating the cooling system even when the average temperature of the room is comfortable. It is apparent that this causes inefficiencies.

For example, when the heating and cooling system is heating a room, in order to heat the lower part of a room to a comfortable temperature, it is often necessary to "overheat" the upper half of a room. Likewise, when the heating and cooling system is cooling a room it is often necessary to "over-cool" the lower half of a room to obtain a comfortable temperature in the upper half.

In the past, fans have been used to circulate the air within the room in order to balance the temperature within a room. This circulation prevents stratification of the hot and cool air thereby causing the entire room to be at substantially the same temperature.

However, the increased circulation of fans also create inefficiencies. For instance, on cold days, this increased circulation of air within a room causes the air to move across cooler surfaces, such as windows and external walls, thereby increasing the caloric loss of the air over these surfaces and decreasing the efficiency of the overall system. Likewise, it is apparent that similar inefficiencies exist on warm days if fans circulate cooled air across warmer surfaces, such as windows.

These inefficiencies are offset by the efficiencies resulting from operation of the fans during operation of the air conditioning system. However, there is a net decrease in the efficiency of the system if the air is being circulated when the heating system is not operating.

SUMMARY OF THE INVENTION

Accordingly, it is an object of this invention to at least partially overcome the disadvantages of the prior art. Also, it is an object of this invention to provide an alternative type of heating and cooling system which operates fans located in rooms only when the heating and cooling systems are active. In this way, the beneficial aspects of the increased circulation in a room can be enjoyed while the heating and cooling system is active, while at the same time avoiding the negative efficiencies resulting from circulating air in a room when the heating and cooling system is not active.

It is a further object of the present invention to provide a simple and inexpensive switching means which may be easily installed and allows existing ceiling fans to be automatically activated at substantially the same time as the heating or cooling source.

Accordingly, in one of its aspects, this invention resides in providing an air conditioning system for heating or cooling a volume of air, said air conditioning system comprising:

air conditioning means activatable to heat or cool the volume of air and operable to receive a first control signal and a second control signal;

control means for controlling the air conditioning means and operable to send the first control signal and the second control signal;

sensing means for sensing when the air conditioning means is active and operable to send a third control signal;

air circulation means located within the volume of air for circulating the air within the volume of air in response to the third control signal;

wherein the air conditioning means is activated in response to the first control signal and the air conditioning means is deactivated in response to the second control signal; and wherein the sensing means sends the third control signal substantially simultaneously after sensing activation of the air conditioning means.

Further aspects of the invention reside in providing an air conditioning system for heating or cooling a volume of air, said air conditioning system comprising:

air conditioning means activatable to heat or cool the volume of air and operable to receive a first control signal and a second control signal;

control means for controlling the air conditioning means and operable to send the first control signal and the second control signal;

sensing means for sensing when the air conditioning means is active and operable to send a third control signal and a fourth control signal;

air circulation means located within the volume of air, activatable to circulate the air within the volume of air and operable to receive the third control signal and the fourth control signal;

wherein the air conditioning means is activated in response to the first control signal and the air conditioning means is deactivated in response to the second control signal;

wherein the sensing means sends the third control signal upon sensing activation of the air conditioning means;

wherein the sensing means sends the fourth control signal upon sensing deactivation of the air conditioning means; and wherein the air circulation means is activated in response to the third control signal and the air circulation means is deactivated in response to the fourth control signal.

In still a further aspect, the invention resides in providing a method of heating or cooling a volume of air comprising the steps of:

sensing the temperature of the volume of air;

comparing the sensed temperature to a predetermined temperature;

activating a air conditioning means to heat or cool the volume of air if the sensed temperature is substantially different from the predetermined temperature; and activating an air circulation means located within the volume of air for circulating the air within the volume of air at substantially the same time as the air conditioning means is activated.

In a further aspect the present invention relates to a switching device for activating and deactivating an air circulation means located within a volume of air and capable of circulating the air within the volume of air, said switching device comprising:

sensing means operable to sense activation of a air conditioning means, said heating means activatable to heat or cool the volume of air;

wherein the sensing means is operable to generate and send an activation control signal to the air circulation means to activate the air circulation means substantially simultaneously after activation of the air conditioning means has been sensed.

Further aspects of the invention will become apparent upon reading the following detailed description and the drawings which illustrate the invention and preferred embodiments of the invention.

BRIEF DESCRIPTION OF THE DRAWINGS

In the drawings, which illustrate embodiments of the invention.

DETAILED DESCRIPTION OF PREFERRED EMBODIMENTS OF THE INVENTION

Figure 1:
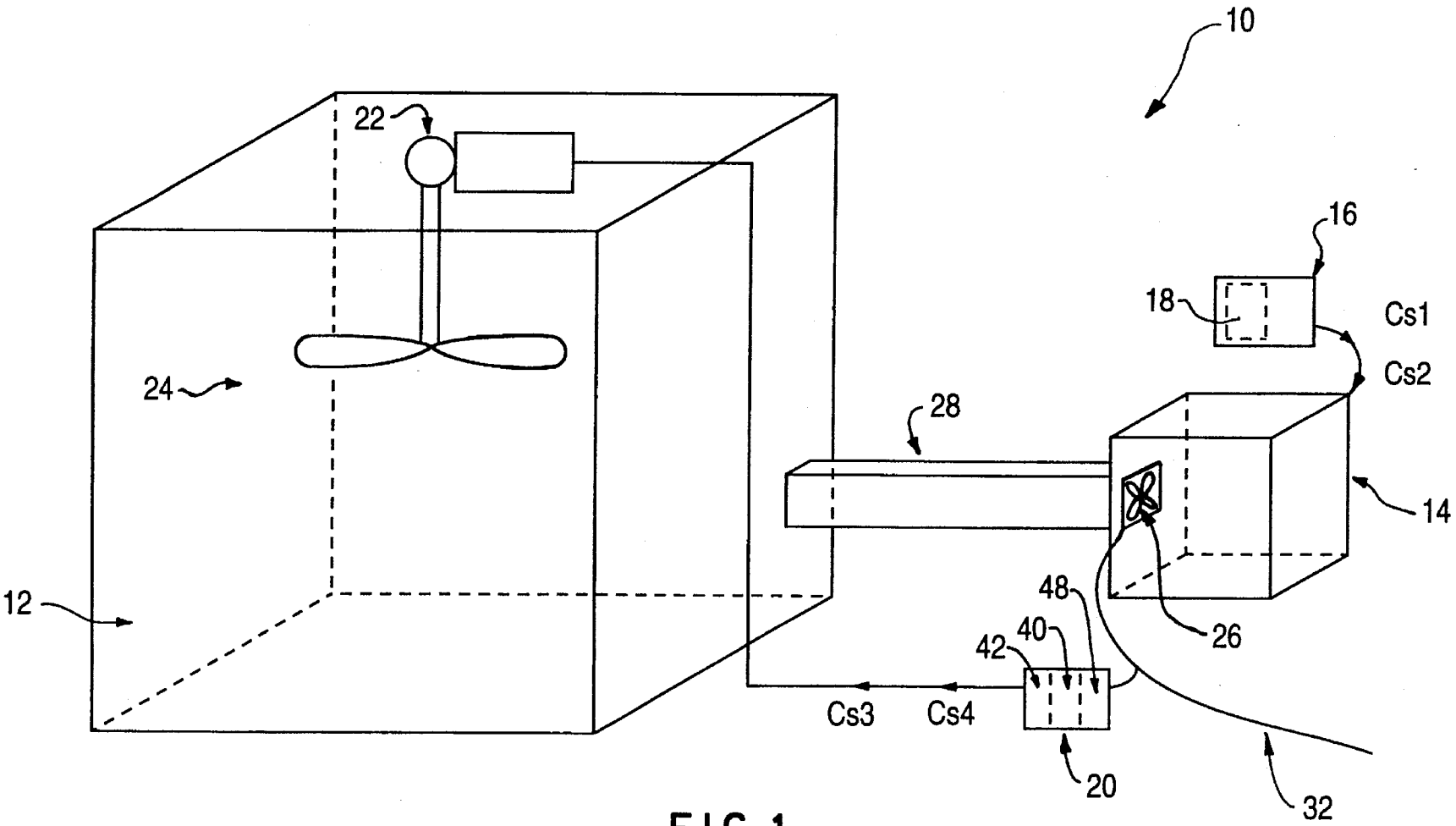
FIG. 1 is a symbolic representation of one embodiment of the invention.

As shown in FIG. 1, the present invention in one embodiment comprises the air conditioning system, shown generally in FIG. 1 as 10, for air conditioning or cooling a volume of air 12.

The air conditioning system 10 comprises a air conditioning means 14 which when activated can heat or cool the volume of air 12. In other words, the air conditioning means 14 can be used to add heat to the volume of air 12 or remove heat in order to cool the volume of air 12. For example, the air conditioning means 14 could be considered a furnace in combination with an air conditioner for providing heat in winter months and removing heat or cooling in summer months. It is noted that whether the air conditioning means 14 is activated to heat or cool the volume of air 12 is not relevant to the present invention, provided when activated the air conditioning means 14 varies the temperature of the volume of air 12.

The air conditioning means 14 is controlled by a control means 16. The control means 16 is operable to send a first control signal CS1 to the air conditioning means 14. The air conditioning means is operable to become activated upon receipt of the first control signal CS1.

Whether upon activation the air conditioning means 14 heats or cools the volume of air 12 is generally predetermined by the control means 16. For instance, using the above example, during the winter months the control means 16 could be set to activate the furnace and during summer months the control means 16 could be set to activate the air conditioner. Generally, the control means 16 would not need to activate the furnace and the air conditioner at the same time of the year. In any event, it is understood that upon receipt of the first control signal CS1 the air conditioning means 14 will either heat or cool the volume of air 12 and it is not material to the present invention whether the air conditioning means 14 heats or cools the volume of air 12.

The control means 16 is also operable to send a second control signal CS2 to the air conditioning means 14. The air conditioning means 14 is operable to receive the second control signal CS2 and to become deactivated in response to the second control signal CS2. In other words, if the air conditioning means 14 has been activated to heat the volume of air 12, it will become deactivated and stop air conditioning the volume of air 12 in response to receiving the second control signal CS2. Likewise, if the air conditioning means 14 had been activated to cool the volume of air 12, then the air conditioning means would be deactivated and would no longer cool the volume of air 12 in response to receiving the second control signal CS2.

In one embodiment, the control means 16 comprises a thermostat 18 which can sense the temperature of the volume of air 12 and compares this sensed temperature to a predetermined temperature to which the thermostat 18 has been set or programmed. The control means 16 will activate the air conditioning means 14 to either heat or cool the volume of air 12 if the comparison of the sensed temperature to the predetermined temperature indicates that the sensed temperature is substantially different from the predetermined temperature. In other words, if the temperature of the volume of air 12 is substantially different from the predetermined temperature, the control means 16 will send a first control signal CS1 to the air conditioning means 14 to activate the air conditioning means 14. If the sensed temperature of the volume of air is not substantially different from the predetermined temperature, the control means 16 will send a second control signal CS2 to the air conditioning means 14 to deactivate the air conditioning means 14.

The system 10 further comprises a sensing means 20 for sensing when the air conditioning means is active. In one embodiment, the sensing means 20 receives or senses the first and second control signals CS1, CS2, and activates or deactivates an air circulation means, shown generally in FIG. 1 as 22, in response thereto. However, in a preferred embodiment, the sensing means 20 senses the actual activation of the air conditioning means 14. Upon sensing the activation of the air conditioning means 14, the sensing means 20 sends a third control signal CS3 to the air circulation means shown generally in FIG. 1 as 22.

As shown in FIG. 1, the air circulation means 22 is located within the volume of air 12. The air circulation means 22 can comprise any device for circulating air and is preferably a fan 24 located in the upper part of the volume of air 12. Furthermore, it is preferable that the fan 24 is oriented such that when activated the fan 24 moves air in a vertical manner.

The air circulation means 22 is operable to receive the third control signal CS3 and to commence circulating the air within the volume of air 12 in response to the third control signal CS3. As stated above, the sensing means 20 sends the third control signal CS3 substantially simultaneously after sensing the activation of the air conditioning means 14. Accordingly, the air circulation means 22 is activated and circulates the air within the volume of air 12 substantially simultaneously as the air conditioning means 14 becomes activated to heat or cool the volume of air 12.

In addition, the sensing means 20 is also operable to sense the deactivation of the air conditioning means 14 and to send a fourth control signal CS4 upon sensing the deactivation of the air conditioning means 14. In response to the fourth control signal CS4, the air circulation means 22 is deactivated and ceases circulating the air within the volume of air 12.

In a preferred embodiment, the air conditioning means 14 is a conventional forced air heating and cooling system having a heater fan 26. This heater fan is activated in order to force hot or cool air, depending on whether the air conditioning means 14 is heating or cooling the volume of air 12, into the volume of air 12 via duct 28.

During operation of the system 10, the thermostat 18 senses the temperature of the air in the volume of air 12. Once the sensed temperature is substantially different from a predetermined temperature, for example 0.5 to 4 degrees Centigrade depending on the specific application, the control means 16 will send the first control signal CS1 to the air conditioning means 14. The first control signal CS1 is received by the air conditioning means 14 and the heating means 14 becomes activated in response to the first control signal CS1.

If we take the case where the heating means is a forced air gas furnace, a burner (not shown) within the air conditioning means 14 heats a plenum (not shown) thereby heating the air entering the duct 28 and the volume of air 12. It is noted that in most cases a return air duct (not shown) is used to return air from the volume of air 12 back to the air conditioning means 14 to be heated and returned to the volume of air 12.

It is noted that in most forced air heating and cooling systems, the heater fan 26 only commences to operate once the plenum (not shown) has been heated to a sufficient temperature. At this time, the heater fan 26 commences to operate forcing the hot air from the plenum (not shown) through the heater ducts 28 and into the volume of air 12.

It is noted that the air conditioning means 14 is considered to be activated once the heater fan 26 commences to operate and warm air enters the duct 28. Accordingly, the activation of the air conditioning means 14 does not necessarily occur at the same time as the air conditioning means 14 receives the first control signal CS1.

While the air conditioning means 14 is heating or cooling the air in the volume of air 12, the thermostat 18 is sensing the temperature of the volume of air. Once the sensed temperature is not substantially different from the predetermined temperature, the control means 16 will send the second control signal CS2 to the air conditioning means 14. The air conditioning means 14 will turn the burners (not shown) off and stop heating the plenum (not shown). However, the air conditioning means 14 will continue to operate the heater fan 26 until the temperature of the plenum lowers to a set temperature at which time the air conditioning means 14 stops the heater fan 26 from operating.

It is noted that the air conditioning means 14 is considered to be deactivated once the heater fan 26 ceases to operate. Accordingly, the deactivation of the air conditioning means 14 does not necessarily occur at the same time as the air conditioning means 14 receives the second control signal CS2.

Figure 2:
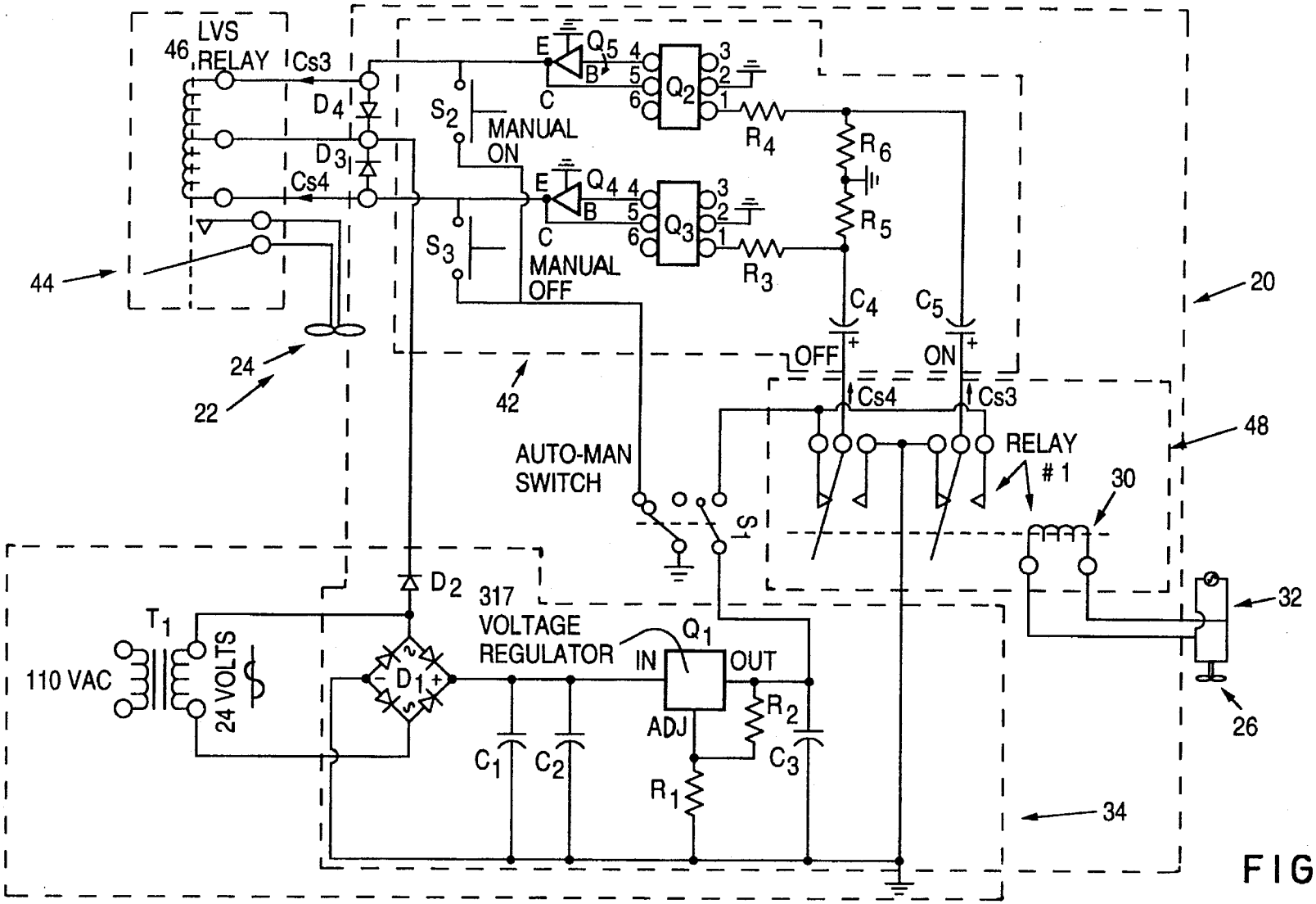
FIG. 2 is a circuit drawing showing the different components of one embodiment of the present invention.

In one embodiment, the sensing means 20, as shown in FIG. 2, comprises a double pole double throw relay shown generally in FIG. 2 as relay 1 which forms part of sensing relay means 48. Relay 1 has a coil 30 which in one embodiment of the invention is connected in parallel to the power lines 32 supplying electrical power to the heater fan 26. In this way, the sensing means 20 can sense the activation of the air conditioning means 14 by sensing when power is being supplied to heater fan 26. As also shown in FIG. 2, the sensing means 20 sends the third and fourth control signals CS3, CS4, in response to the activation and deactivation, respectively, of coil 30 as described more fully below.

Relay 1, as shown in FIG. 2, is supplied electrical power from DC power supply 34. DC power supply 4 comprises a transformer T1 for transforming the standard household electrical voltage to a lower voltage and may correspond the control transformer existing in the air conditioning means 14. In FIG. 2, transformer T1 is shown transforming the standard North American voltage of 110 VAC down to 24 VAC. This power is then converted to direct current by rectifier D1 in a known manner. In order to further modify the direct current, capacitors C1 and C2 are utilized to eliminate any transient components of the direct current. Preferably, capacitors C1 and C2 are about 2200 ufd.

The direct current is then regulated by voltage regulator Q1 and adjusted by resistors R1 and R2 in a known manner. In a preferred embodiment, the direct current voltage is adjusted to about 12 VDC. A further capacitor, capacitor C3, preferably about 1 ufd, further filters the transient components of the direct current after it has been regulated.

The direct current from the direct current power supply 34 passes through an auto-manual switch S1 and into the sensing relay means 48 and provides the power for generating the third and fourth control signals CS3 and CS4. The auto-manual switch S1 is a standard switch provided for by-passing the sensing relay means 48 and therefore prevents the air conditioning means 14 and sensing means 20 from automatically activating the air circulation means 22 when in the manual position.

Auto-manual switch S1 as shown in FIG. 2 is open and therefore the system 10 is in the manual mode of operation and sensing means 20 is by-passed. In this setting, the air circulation means 22 is manually operated by on and off switches S2 and S3, respectively. Furthermore, the auto-manual switch S1 is preferably of a double pole double throw configuration so that switches S2 and S3 are connected to ground, and therefore operable, only when the auto-manual switch S1 is in the manual setting shown in FIG. 2. In this way, only the sensing relay means 48 or the manual switches S2 and S3 can activate the air circulation means 22, but not both at the same time.

When auto-manual switch S1 is in the closed position, and therefore in the automatic mode of operation, direct current from the direct current power supply 34 passes through relay 1 and provides the power to the sensing relay means 48 to generate control signals CS3 and CS4. In addition, when the auto-manual switch S1 is in the closed position, the manual switches S2 and S3 are not connected to ground and therefore activation of switches S2 or S3 will not cause either control signal CS3 or CS4 to be sent to the air circulation means 22.

In FIG. 2, relay 1 is shown in the "deactivated" mode or "second position" in that it is sending control signal CS4 to the air circulation means 22 to effect deactivation of the fan 24. This is the position relay 1 is in when the coil 30 is not energized.

As shown in FIG. 2, when relay 1 is in the second position sensing relay means 48 generates the fourth control signal CS4 which is received by processing circuit 42. In particular, control signal CS4 is inputted into and energizes capacitor C4 of processing circuit 42. Capacitor C4 and resistor R5 of processing circuit 42 time the fourth control signal CS4 by a time period equivalent to the capacitance of capacitor C4 multiplied by the resistance value of resistor R5. This time period should be of a sufficient duration to allow for the deactivation of the air circulation means 22 and is preferably at least about 50 milliseconds. After this time period, current through capacitor C4, and therefore through resistor R3 and into terminal 1 of opto coupler/isolator Q3, will cease. While current is passing into terminal 1 of the opto coupler/isolator Q3, the LED half of the opto isolator/coupler Q3 is turned on.

As with capacitor C4 and resistor R5 of the processing circuit 42, capacitor C5 and resistor R6 of the processing circuit 42 time the duration of the third control signal CS3. The duration of the third control signal CS3 should be of a sufficient duration to allow for the activation of the air circulation means 22 and is preferably at least about 50 milliseconds.

The third control signal CS3 is generated by relay 1 of sensing relay means 48 when relay 1 is in the "first position" and in this position the contacts of relay 1 are in the opposite position to those shown in FIG. 2. Relay 1 is in the first position when coil 30 is energized. As stated above, coil 30 is connected in parallel with the power supply for the heater fan 26 such that coil 30 becomes energized and moves relay 1 to the first position when power is supplied to heater fan 26 through power line 32.

As with control signal CS4, while control signal CS3 charges capacitor C5, current will flow through resistor R4 and into terminal 1 of opto coupler/isolator Q2 turning on opto coupler/isolator Q2. Once capacitor C5 is charged, current flow trough resistor R4 and into terminal 1 of the opto coupler/isolator Q2 will cease.

The opto isolators Q2 and Q3 form part of the processing circuit shown generally as 42 in FIG. 2 which also includes darlington transistors Q5 and Q4.

With respect to opto isolator Q3 and darlington transistor Q4, when the control signal CS4 is charging capacitor C4, the current passing through capacitor C4 gates or turns on the LED half of the opto isolator Q3 which gates or turns on the output side of the opto isolator Q3 shown at terminals 4 and 5. When the output half of the opto coupler/isolator Q3 turns on, it turns on or gates a darlington transistor Q4. While the darlington transistor Q4 is turned on, a 24 volt half wave passes through diode D2, shown forming part of the DC power supply 34 through part of the LVS relay 46 and into darlington transistor Q4. Accordingly, in this embodiment, the fourth control signal CS4 from the sensing means 20 to the switching means 44 corresponds to the 24 volt half wave passing through diode D2 and into darlington transistor Q4 while darlington transistor Q4 is turned on. In addition, in this embodiment, it is this 24 volt half wave corresponding to the fourth control signal CS4 which provides the power to energize the LVS (low voltage) relay 46 of switching means 44 in order to deactivate the fan 24.

Once capacitor C4 is charged, the current ceases and the opto coupler/isolator Q3, as well as the darlington transistor Q4, turn off. This stops the flow of current through diode D2 and the LVS relay 46 is latched at the open position shown in FIG. 2.

In this way the short electrical pulses necessary to activate LVS relay 46 of switching means 44 are sent by the sensing means 20 to the switching means 44. The timed fourth control signal CS4 from darlington transistor Q4 causes the LVS relay 46 to move and latch the switch for the fan 24 at the open position as shown in FIG. 2. At this point, the air circulation means 22 is deactivated.

Control signal CS3 is processed in a similar manner by capacitor C5, opto isolator Q2 and darlington transistor Q5. However, the timed pulse from darlington transistor Q5 corresponding to the third control signal CS3 causes the 24V half wave passing through diode D2 to pass through the LVS relay 46 such that the switch for the fan 24 moves into and is latched in the closed position. In this way the air circulation means 22 becomes activated as is apparent from the circuit diagram shown in FIG. 2.

Furthermore, as shown in FIG. 2, sensing means 20 preferably comprises shorting diodes D3 and D4. Shorting diodes D3 and D4 protect the processing circuit 42 from counter-electromagnetic flux produced by the LVS relay 46.

When the coil 30 is not energized and the relay 1 is in the second position as stated above, capacitor C4 is being charged by control signal CS4, and relay 1 simultaneously allows capacitor C5 to be discharged by having a connection from capacitor C5 through relay 1 to ground. In this way, relay 1 discharges capacitor C5 while charging capacitor C4.

Likewise, it is apparent that when the coil 30 of the switching means 20 is energized and relay 1 has been moved to the "first position" relay 1 connects capacitor C5 of processing circuit 42 to the positive filtered DC terminal of the DC power supply 34 thereby sending the third control signal CS3. Simultaneously, relay 1 connects capacitor C4 of processing circuit 42 to ground thereby discharging capacitor C4. This arrangement permits instantaneous recycling of the processing circuit 42.

The LVS relay 46 shown in FIG. 2 can be energized by the 24 volt half wave which is provided through diode D2 from transformer T1 and this half wave is applied for preferably a time period of at least about 50 milliseconds in duration. The half wave provided through diode D2 is grounded through either darlington transistor Q4 or Q5 depending on whether the LVS relay 46 is activating or deactivating the fan 24 and in the manner described above. It is apparent that the manual on and off switches S2 and S3 have a similar effect to the darlington transistors Q4 and Q5 by grounding the 24 volt AC half wave from diode D2.

It is also apparent that opto isolators Q3 and Q4 isolate the 24 volt AC half wave passing through diode D2, which energizes the LVS relay 46, from the 12 volt DC signal passing through relay 1 and powering control signals CS3 and CS4.

In this way, a air conditioning and cooling system is provided to automatically activate a fan 24, or other circulation type device located within the volume of air 12 to be heated or cooled, substantially at the same time as the air conditioning means 14 commences to heat or cool the volume of air 12.

It is understood that control signals CS3 and CS4 need not be transferred on two separate lines but could be sent on a single line. Likewise, it is apparent to persons skilled in art that the third and fourth control signals CS3 and CS4 need not a 24 V half wave but could be other forms of signals such as binary computer signals, amplitude modulated signals, frequency modulated signals, etc. However, it is noted that by having a three wire system operating at 24 volt transferring the third and fourth control signals CS3 and CS4 from the processing means 42 to the switching means 44, a standard low voltage electrical wire such as door bell wire can be used to connect the processing means 42, which forms part of the sensing means 20 and is generally located near the air conditioning means 14, to the switching means 44, which is generally located near the air circulation means 22. Use of low voltage wiring is safer to install and is subject to minimal building regulations. It is apparent that this simplified connection of the air circulation means 22 to the sensing means 20 therefore simplifies the entire system 10. In addition, this connection permits several LVS relays, each controlling a specific fan 24, to be connected in parallel to the sensing means 20.

Furthermore, it is understood that the volume of air 12 could be any partially or totally enclosed volume of air. However, generally, the volume of air 12 would be the air within a room. It is noted that the size of the volume of air 12, or the room within which the volume of air 12 is located, does not affect the present invention and the present invention could be used for any size volume of air, provided that the fan 24 is large enough or that there are sufficient number of fans 24 to effect circulation of the air within the volume of air 12.

It is also noted that the control means 16 and thermostat 18 need not be located within the volume of air 12 in order to sense the temperature of the air 12. For example, if the volume of air 12 is considered to be a room in a house or apartment, the thermostat 18 may be located within the room having the air circulation means 22 or in another room of the house which may or may not have another air circulation means. Generally, houses and apartments have one thermostat 18 located in one room to sense the temperature of the air in all of the rooms of the house or apartment and it does not matter if the air circulation means 22 is in the room with the thermostat or not. However, it is preferable to have an air circulation means 22 located in the room having the thermostat 18 so that the thermostat 18 may more accurately sense the temperature of the room as the temperature of the air within a room having an air circulation means 22 will be more evenly balanced.

It should be noted that the control means 16 need not have two separate wires to send the control signals CS1 and CS2 to the air conditioning means 14. For example, control signals CS1 and CS2 could simply be a binary high and low signal sent on a single wire. In this way, the control means 16 could send a high signal or a low signal to the air conditioning means 14 representing the first and second control signals CS1 and CS2.

It is also understood, that if a separate second control signal CS2 is sent by the control means 16, then this second control signal need not be continuously sent for the entire period of time the sensed temperature is not substantially different from the predetermined temperature. Rather, the second control signal CS2 could be a pulse signal which is sent to deactivate the air conditioning means 14 at which point the air conditioning means 14 remains deactivated until the first control signal CS1 is sent. The reverse is also true of the first control signal CS1. Furthermore, a similar arrangement could be used for third and fourth control signals CS3 and CS4.

In a preferred embodiment of the present invention, the air conditioning means 14 is a conventional forced air conditioning means 14, such as a furnace and air conditioner combination, and the sensing means 20, as shown in FIG. 2, is adapted to sense the activation of the heater fan 26 of this forced air heater system. However, it is understood that the present invention is not limited to a forced air heater system. Rather, the present invention is applicable to any type of air conditioning means 14 which can heat or cool a volume of air 12, such as convection air conditioning, electric heating, water radiator air conditioning, infra-red radiated air conditioning, solar air conditioning, etc.

It is also understood that the sensing means 20 can indirectly sense activation and deactivation of the air conditioning means 14 for example by sensing the first and second control signals CS1, CS2. In this case, a circuit similar to that shown in FIG. 2 would be used but the coil 30 would become energized upon sensing the first control signal CS1 and de-energized upon sensing the second control signal CS2.

It is also understood that the present invention is applicable to two-speed forced air furnaces. These furnaces have a fan which operates at a low speed continuously and operates at a high speed when the air conditioning means 14 is activated. It is apparent that in these two-speed forced air systems the sensing means 20 would sense activation of the air conditioning means 14 by sensing the fan speed increasing from the low to high speed.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

The embodiments of the invention in which an exclusive property or privilege is claimed are defined as follows:

1. An air conditioning system for heating or cooling a volume of air, said air conditioning system comprising:

air conditioning means activatable to heat or cool the volume of air and operable to receive a first control signal and a second control signal;

control means for controlling the air conditioning means and operable to send the first control signal and the second control signal;

sensing means for sensing when the air conditioning means is active and operable to send a third control signal;

air circulation means located within the volume of air and activatable to circulate the air within the volume of air in response to the third control signal;

wherein the air conditioning means is activated in response, to the first control signal and the air conditioning means is deactivated in response to the second control signal;

wherein the sensing means sends the third control signal substantially simultaneously after sensing activation of the heating means;

wherein the sensing means is operable to send a fourth control signal upon sensing deactivation of the air conditioning means;

wherein the air circulation means is deactivated in response to the fourth control signal;

heater fan means for forcing hot or cool air from the air conditioning means to the volume of air, said heater fan means being supplied electrical power by a power line; and wherein said sensing means comprises sensing relay means operable to generate the third control signal when in a first position and to generate the fourth control signal when in a second position, said sensing relay means including a coil means operable to move the sensing relay means to the first position from the second position when energized, said coil means being connected in parallel to said power line supplying power to said heater fan means such that activation of the heater fan means energizes the coil means thereby causing the sensing relay means to move to the first position from the second position.

2. The air conditioning system as defined in claim 1 wherein the air circulation means comprises a circulation fan means.

3. The air conditioning system as defined in claim 2 wherein the circulation fan means is located in the upper part of the volume of air.

4. The air conditioning system as defined in claim 1 wherein the control means comprises:

thermostat means for sensing the temperature of the volume of air and for comparing the sensed temperature to a predetermined temperature to determine if the first control signal or the second control signal is to be sent.

5. The air conditioning system as defined in claim 1 wherein the sensing means further comprises:

processing means for receiving the third and fourth control signals generated by the sensing relay means and processing the third and fourth control signals into signals of at least about 50 milliseconds in duration and comprising short electrical pulses.

6. The air conditioning system as defined in claim 5 wherein said air circulation means comprises:

circulation means for circulating the air within the volume of air; and switching means for activating and deactivating the circulation means, said switching means comprising a low voltage switching relay means for activating and deactivating said circulation means in response to the short electrical pulses of the third and fourth control signals.

7. The air conditioning system as defined in claim 6 wherein the circulation means comprises a circulation fan means.

8. The air conditioning system as defined in claim 7 wherein the circulation fan means is located in the upper part of the volume of air.

9. The air conditioning system as defined in claim 8 wherein the volume of air is a room having a ceiling and the circulation fan means is located near the ceiling.

10. A air conditioning system for air conditioning or cooling a volume of air, said air conditioning system comprising:

air conditioning means activatable to heat or cool the volume of air and operable to receive a first control signal and a second control signal;

control means for controlling the air conditioning means and operable to send the first control signal and the second control signal;

sensing means for sensing when the air conditioning means is active and operable to send a third control signal and a fourth control signal;

air circulation means located within the volume of air, activatable to circulate the air within the volume of air by a low voltage relay means which is responsive to short electrical pulses and operable to receive the third control signal and the fourth control signal;

wherein the air conditioning means is activated in response to the first control signal and the air conditioning means is deactivated in response to the second control signal;

wherein the sensing means sends the third control signal upon sensing activation of the air conditioning means;

wherein the sensing means sends the fourth control signal upon sensing deactivation of the air conditioning means;

wherein the air circulation means is activated in response to the third control signal and the air circulation means is deactivated in response to the fourth control signal.

11. The air conditioning system as defined in claim 10 wherein the air conditioning system comprises a heater fan means for forcing hot or cool air from the air conditioning means to the volume of air, said heater fan means being supplied electrical power by a power line; and sensing relay means operable to generate the third control signal when in a first position and to generate the fourth control signal when in a second position, said sensing relay means including a coil means operable to move the relay means to the first position from the second position when energized, said coil means being connected in parallel to said power line supplying power to said heater fan means such that activation of the heater fan means energizes the coil means thereby causing the sensing relay means to move to the first position from the second position.

12. The air conditioning system as defined in claim 11 wherein the air circulation means comprises a circulation fan means.

13. A method of air conditioning or cooling a volume of air comprising the steps of:

sensing the temperature of the volume of air;

comparing the sensed temperature to a predetermined temperature;

activating an air conditioning means to heat or cool the volume of air if the sensed temperature is substantially different from the predetermined temperature;

activating an air circulation means located within the volume of air for circulating the air within the volume of air at substantially the same time as the air conditioning means is activated;

deactivating the air conditioning means if the sensed temperature is not substantially different from the predetermined temperature;

deactivating the air circulation means at substantially the same time as the air conditioning means is deactivated; and wherein the air circulation means is activated and deactivated by a low voltage relay means which is responsive to short electrical pulses.

14. The method of air conditioning and cooling a volume of air as claimed in claim 13 wherein the air circulation means comprises a circulation fan means such that the circulation fan means rotates when the air circulation means is activated and the circulation fan means does not rotate when the air circulation means is deactivated.

15. A switching device for activating and deactivating an air circulation means located within a volume of air and capable of circulating the air within the volume of air, said switching device comprising:

sensing means operable to sense activation of an air conditioning means, said air conditioning means activatable to heat or cool the volume of air;

wherein the sensing means is operable to generate and send an activation control signal to the air circulation means to activate the air circulation means substantially simultaneously after activation of the air conditioning means has been sensed;

wherein said sensing means is operable to sense deactivation of the air conditioning means and to generate and send a deactivation control signal to the air circulation means to deactivate the air circulation means substantially simultaneously after deactivation of the air conditioning means has been sensed;

wherein said sensing means further comprises sensing relay means operable to generate the activation control signal when in a first position and to generate the deactivation control signal when in a second position, said sensing relay means including a coil means operable to move the relay means to the first position from the second position when energized;

wherein said coil means is operable to be connected in parallel to a power line supplying power to a heater fan means of said air conditioning means such that activation of the heater fan means energizes the coil means thereby causing the sensing relay means to move to the first position from the second position.

16. The switching device as defined in claim 15 further comprising:

processing means for receiving the activation and deactivation control signals generated by the sensing relay means and processing the activation and deactivation control signals into signals of at least about 50 milliseconds in duration and comprising short electrical pulses for activating and deactivating a low voltage switching relay means associated with the air circulation means.

* * * * *